US006899279B2

(12) United States Patent
Seitz

(10) Patent No.: US 6,899,279 B2
(45) Date of Patent: May 31, 2005

(54) ATOMIZER WITH LOW PRESSURE AREA PASSAGES

(75) Inventor: David M. Seitz, Riga, MI (US)

(73) Assignee: Illinois Tool Works Inc., Glenview, IL (US)

( * ) Notice: Subject to any disclaimer, the term of this patent is extended or adjusted under 35 U.S.C. 154(b) by 80 days.

(21) Appl. No.: 10/647,417

(22) Filed: Aug. 25, 2003

(65) Prior Publication Data

US 2005/0045735 A1 Mar. 3, 2005

(51) Int. Cl.[7] ..... B05B 17/04

(52) U.S. Cl. ..... 239/7; 239/104; 239/224; 239/288; 239/288.5; 239/290; 239/296

(58) Field of Search ..... 239/7, 104, 223, 239/224, 288, 288.3, 288.5, 290, 296; 188/626; 427/248.1

(56) References Cited

U.S. PATENT DOCUMENTS

| | | | | |
|---|---|---|---|---|
| 4,447,008 | A | 5/1984 | Allen | |
| 4,546,923 | A | 10/1985 | Ii | |
| 4,555,058 | A * | 11/1985 | Weinstein et al. | 239/223 |
| 4,572,437 | A | 2/1986 | Huber et al. | |
| 4,601,921 | A | 7/1986 | Lee | |
| 4,776,520 | A | 10/1988 | Merritt | |
| 4,928,883 | A * | 5/1990 | Weinstein | 239/223 |
| 4,936,510 | A | 6/1990 | Weinstein | |
| 5,697,559 | A | 12/1997 | Davis et al. | |
| 5,820,036 | A | 10/1998 | Saito | |
| 5,862,988 | A * | 1/1999 | van der Steur | 239/288.5 |
| 5,941,457 | A | 8/1999 | Nakazono et al. | |
| 5,954,275 | A | 9/1999 | Honma et al. | |
| 5,980,994 | A | 11/1999 | Honma et al. | |
| 6,003,784 | A | 12/1999 | van der Steur | |
| 6,050,499 | A * | 4/2000 | Takayama et al. | 239/296 |
| 6,053,428 | A | 4/2000 | Van Der Steur | |
| 6,056,215 | A | 5/2000 | Hansinger et al. | |
| 6,557,781 | B2 * | 5/2003 | Kon | 239/224 |

FOREIGN PATENT DOCUMENTS

| | | |
|---|---|---|
| EP | 1 331 037 | 7/2003 |
| JP | 3101858 | 4/1991 |

* cited by examiner

*Primary Examiner*—Steven J. Ganey
(74) *Attorney, Agent, or Firm*—Lisa M. Soltis; Mark W. Croll; Donald J. Breh

(57) ABSTRACT

A rotary atomizing applicator is provided with passages directing ambient air to an area of low-pressure created behind a rotary atomizer of the applicator. The passages have ambient air openings thereto remote from the rotary atomizer. When a low-pressure area is created by the pumping effect from the rotary atomizer, ambient air is drawn through the passages to reduce the low-pressure area.

20 Claims, 2 Drawing Sheets

ATOMIZER WITH LOW PRESSURE AREA PASSAGES

FIELD OF THE INVENTION

The present invention relates generally to coating applicators and, more particularly, the present invention relates to rotary atomizing applicators used to apply paint and other coatings.

BACKGROUND OF THE INVENTION

It is known to use automated spray applicators to apply coatings of various types on objects during manufacture. Automobile vehicle bodies commonly are coated using robotic devices with spray applicators. The robot is programmed to perform a sequence of maneuvers and adjustments so that the vehicle body pieces are adequately and precisely covered in a rapid procedure with minimal waste.

To reduce the amount of over spray and further reduce waste, it is known to use atomizing applicators. A bell cup rotates at high speed, and the coating material, such as paint, is provided to the inside of the cup. As the paint or other coating moves outwardly and off the cup surface as a result of centrifugal force, the coating is atomized into a fine mist and directed at the object to be coated. It is known to use shaping air streams to confine and direct the atomized coating toward the object. It is also known to charge the atomized mist with electrical potential and to ground the object being coated so that the coating material is attracted to the object, further reducing over spray and improving coverage on irregularly shaped target objects.

In present day manufacturing procedures, such as for automobile vehicle bodies, it is common to have parts in random color sequences advancing along a manufacturing line. Thus, for each object to be coated it may be necessary to change the color of paint or other coating used from that used for the previous object. To ensure purity of the coating to be applied, it is necessary to clean at least parts of the coating applicator. It is also necessary to routinely clean the atomizer for continued proper operation.

A problem associated with known rotary atomizers is caused by the pumping effect of the bell cup rotating at high velocities. At such high speeds, the bell cup operates as an effective air pump, evacuating air from just behind the bell cup. Therefore, a low-pressure area exists immediately behind the bell cup and in front of the forward end of the applicator shroud. Surrounding air, which may contain atomized mist from the applicator, tends to fill the low-pressure area behind the bell cup. As a result, the back of the bell cup can become covered with coating in a relatively short period of time, necessitating cleaning. It is desirable to minimize the frequency of and time needed for cleaning. It is also desirable to minimize as much as possible the volume of cleaning agents required. For many coatings, the cleaning agents are considered hazardous waste and must be properly handled for disposal. Minimizing cleaning frequencies and reducing the amount of cleaning agent required can significantly decrease costs and increase productivity of a coating operation.

What is needed in the art is a simple yet effective system for reducing the low-pressure area created behind a rotating bell cup in an atomizing applicator.

SUMMARY OF THE INVENTION

The present invention provides a passive system to relieve the low-pressure area, including passages in the atomizer shroud behind the bell cup to provide remote ambient air for filling the normally low-pressure area behind the bell cup.

In one aspect thereof, the present invention provides a coating material applicator with an applicator body and a rotary atomizing head at one end of the body. Air passages provide a natural flow of ambient air to the low-pressure area behind the rotary atomizing head. Each passage has a first opening remote from the head exposed to ambient air and a second opening behind the head in the low-pressure area created by rotation of the rotary atomizing head.

In another aspect thereof, the present invention provides a shroud for an applicator having a rotary atomizing head. The shroud has a side wall having a side surface and an end wall at one end of the side wall, the end wall having an end surface. At least one passage is defined through the side wall, each passage having a first air opening thereto in the side surface exposed to ambient air and a second opening thereto in the end surface.

In still another aspect thereof, the present invention provides a method of operating a rotary atomizing applicator with steps of rotating a rotary atomizing head at high speed, thereby creating an area of low pressure behind the rotating head; and directing a natural flow of ambient air through passages having openings behind the rotary atomizing head.

An advantage of the present invention is providing a passive system without moving parts for filling the low-pressure area behind a rotating bell cup of an atomizing applicator.

Another advantage of the present invention is reducing contamination and soiling of the bell cup outer surface, thereby reducing the need for cleaning the outer surface and reducing the amount of cleaning agents required for cleaning.

Still another advantage of the present invention is reducing the area of low-pressure behind the bell cup of a rotary atomizer by providing a modified shroud configuration that can be used on rotary atomizers of different types, and that can be installed on rotary atomizers as a retrofit easily, conveniently and inexpensively.

A further advantage of the present invention is providing an arrangement to fill the low-pressure area behind a rotary atomizer, which includes no additional moving parts and is therefore reliable in long-term operation.

Other features and advantages of the invention will become apparent to those skilled in the art upon review of the following detailed description, claims and drawings in which like numerals are used to designate like features.

Figure 1:
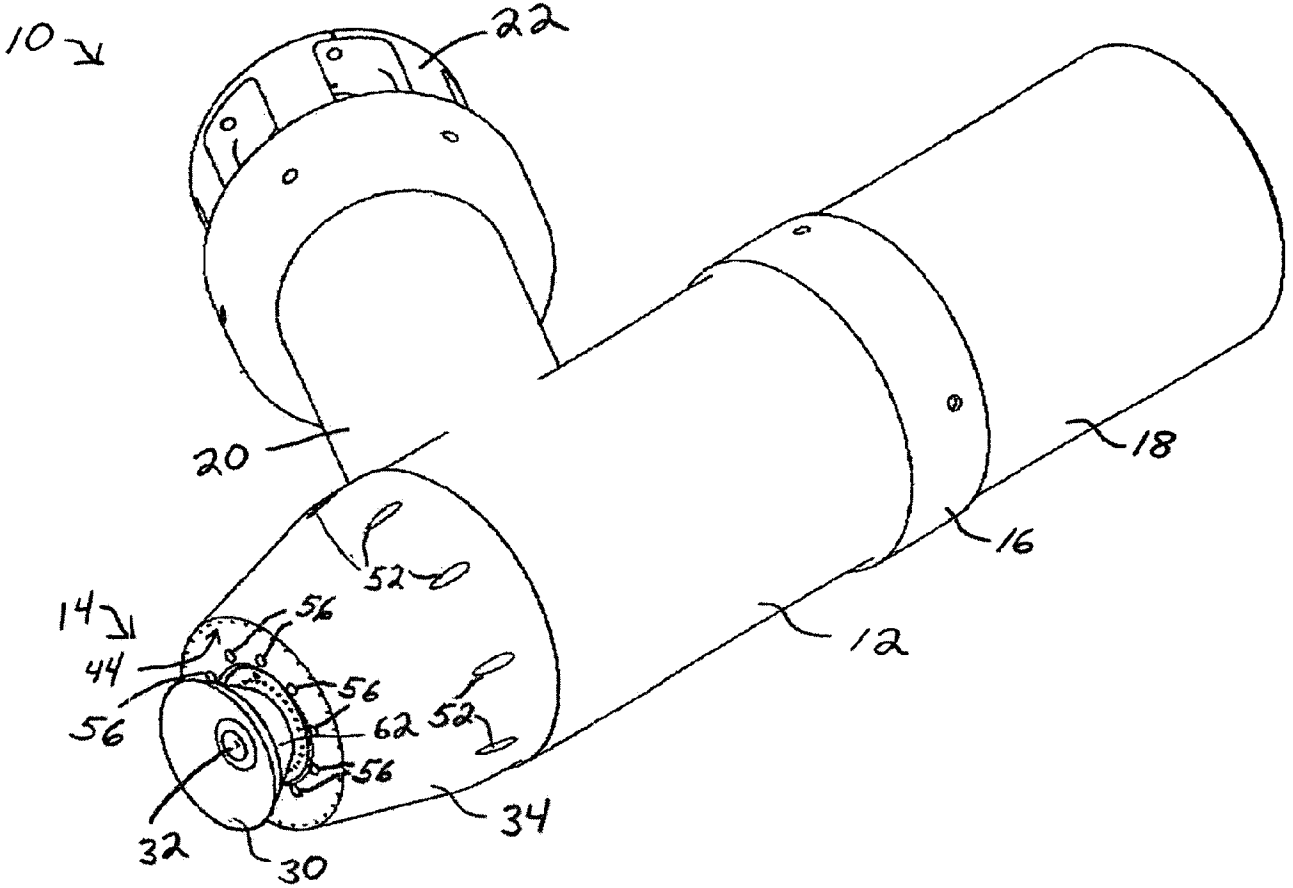
FIG. 1 is a perspective view of a rotary atomizing applicator having a shroud in accordance with the present invention.
Figure 2:
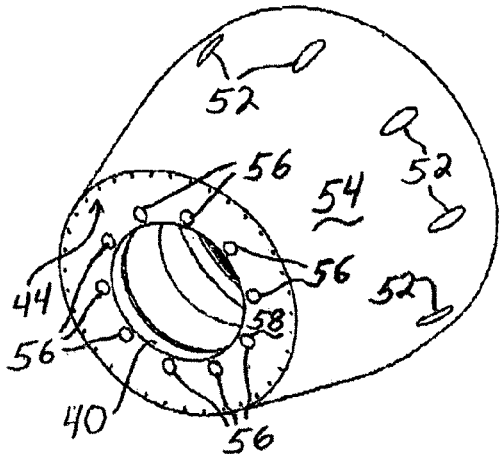
FIG. 2 is a perspective view of the rotary atomizer shroud in accordance with the present invention.
Figure 4:
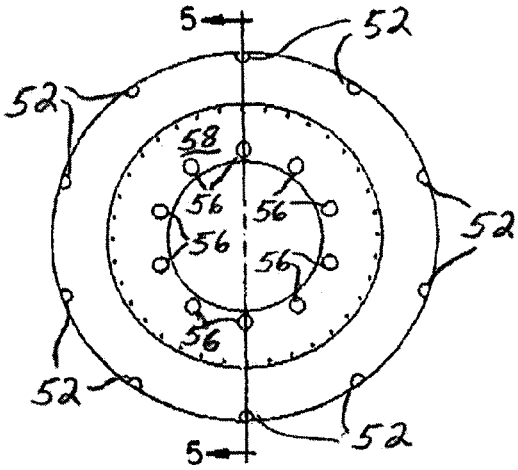
FIG. 4 is an end elevational view of the shroud shown in FIGS. 2 and 3.
Figure 3:
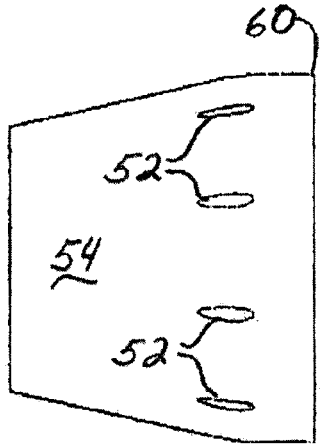
FIG. 3 is a side elevational view of the shroud shown in FIG. 2.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a rotary atomizing coating applicator 10 in accordance with the present invention is shown. As those skilled in the art will understand readily, applicator 10 is mounted on and operated by a robot (not shown) for performing a controlled series of maneuvers to properly and consistently coat a series of objects in a manufacturing process. For example, such applicators are used to paint automobile vehicle body parts. However, applicators of this type also can be used for coating a variety of different objects with paint and other coatings. It should be further understood that the present invention works well with different styles and types of applicators, and applicator 10 shown is merely one example of such a device.

Applicator 10 includes a main body portion 12, which houses an air turbine or other device (not shown) to provide rotary power. An atomizing head 14 is provided on one end of main body 12 and is operated by the air turbine or other rotary power input device (not shown). A canister-docking fixture 16 is provided on an opposite end of main body 12. A canister 18 is connected to fixture 16 and provides a supply of coating material to be applied by applicator 10. It should be understood that other types of coating material supplies can be used for providing coating material to applicator 10, and the present invention is not limited to an applicator 10 having a canister fixture 16 and canister 18. For example, applicator 10 can include connections to sources of a variety of coatings, or can include detachable sources other than canister 18.

Additionally, applicator 10 includes a connector arm 20 by which various electrical, air and/or other systems and supplies are connected to or from a robot (not shown) for operation of applicator 10. A robot adapter 22 is provided for connection to the robot (not shown). For example, arm 20 can include connections to sources of pressurized air to operate an air turbine (not shown) and to shape and direct the atomized mist being applied on an object. Electrical systems, solvent or cleaning fluid supplies and other systems also can be connected through arm 20.

Atomizing head 14 includes a rotary bell cup 30 disposed on a shaft-like end 32 of the air turbine (not shown). End 32 and bell cup 30 are rotated at high speed during operation of applicator 10. The manner in which applicator 10 functions in applying a coating, and the manner in which bell cup 30 operates on coating material supplied thereto to atomize the coating are well-known to those skilled in the art and will not be described in further detail herein.

A shroud 34 is disposed on body 12 at the front end thereof, behind bell cup 30. Shroud 34 covers the air turbine and other components (not shown) at the front end of applicator 10. Shroud 34 is of a generally frustoconical shape, having a side wall 36 and an end wall 38 defining a hole 40 through which shaft-like end 32 extends. Shroud 34 is connected to body 12 by, for example, threads 42 engaging threads (not shown) in main body 12. As known to those skilled in the art, shroud 34 includes a pattern of a plurality of shaping air nozzles 44 in end wall 38. Pressurized air flows from shaping air nozzles 44 for directing the atomized mist of coating material provided from bell cup 30. The shaping air streams from shaping air nozzles 44 flow generally along the outer edge of bell cup 30 to influence the atomized mist forwardly from bell cup 30.

Figure 5:
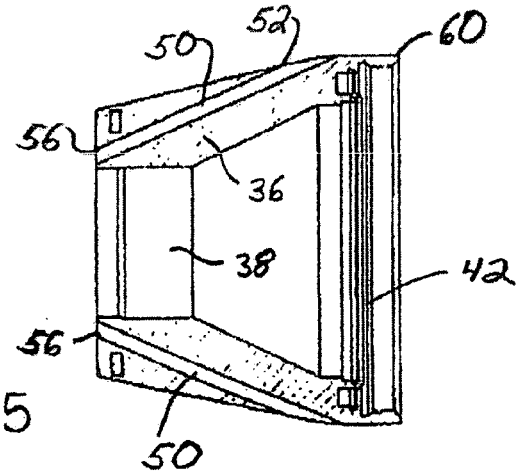
FIG. 5 is a cross sectional view of the shroud shown in the previous views, the cross section having been taken on line 5—5 of FIG. 4.

In accordance with the present invention, shroud 34 is further provided with a plurality of passages 50 (FIG. 5) extending therethrough. Each passage 50 has a first opening 52 on a side surface 54 of shroud side wall 36, and a second opening 56 for each passage 50 provided on a front face or end surface 58 of shroud 34. First openings 52 of passages 50 are provided well rearward from end surface 58, near a rear edge 60 of shroud 34 opposite from end wall 38. With shroud 34 having a generally tapered, somewhat funnel-like or frustoconical shape, first openings 52 are provided at or near a major diameter of shroud 34. Second openings 56 are positioned near hole 40 defined in end 38, through which turbine shaft 32 extends. Second openings 56 are positioned radially inward from the pattern of shaping air nozzles 44, between hole 40 and the pattern of shaping air nozzles 44, and are directed at a radially inner portion of an outside surface 62 (FIG. 1) of bell cup 30, near shaft-like end 32. Second openings 56 are located within the normally low pressure area created behind bell cup 30 during operation of applicator 10.

Passages 50 angle inwardly from first openings 52 thereof to second openings 56 thereof, extending within the thickness of side wall 36. Passages 50 are generally smooth and provide minimal restriction to the flow of air therethrough. In the exemplary embodiment shown in the drawings, shroud 34 is provided with ten passages 50; however, it should be understood that more or fewer passages 50 can be used. If wider passages 50 are used, fewer may be required than if narrower passages 50 are used.

In the use and operation of applicator 10, as bell cup 30 rotates at high speed for the atomization of coating material being applied, a pumping effect is created which removes air and creates a low-pressure area immediately behind bell cup 30. As a result of the reduced pressure in the area behind bell cup 30, ambient air flows naturally through passages 50, without the need for pumping or pressurization. Passages 50 need not be connected to a supply of pressurized air, other than being exposed and open to ambient air immediately surrounding applicator 10. Ambient air enters at first openings 52 and exits at second openings 56. Air flowing through passages 50 "fills" the low-pressure area behind bell cup 34.

Since first openings 52 through which air enters and flows through passages 50 are provided well behind bell cup 34 and at an outer position on shroud 34 remote from atomizing head 14, the air drawn through passages 50 is substantially free from atomized coating material and other contaminants. Thus, relatively "clean" air is provided to fill the normally low pressure area behind bell cup 30. Outside surface 62 of bell cup 30 is maintained in a relatively clean condition, thereby reducing the frequency of required cleanings of the outside of the bell cup, and reducing the use of cleaning fluids. Since atomized coating material mist and/or shaping air is not drawn into the low pressure area behind bell cup 30, each operates more efficiently as intended, and the coating material is directed more precisely at the object to be coated. Therefore, less coating material is wasted, and higher coating efficiencies may result.

The present invention takes advantage of natural flow of air from an area of relatively higher pressure to an area of relatively lower pressure. Ambient air is drawn into the low-pressure area without the need for pressurization by active means. The system is thereby passive, without moving parts. The system remains reliable for prolonged operation and use. Further, since the system is provided entirely within the shroud, it is useful on a variety of applicators, can be supplied inexpensively and is installed quickly and easily as a retrofit on existing applicators.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A coating material applicator comprising:

an applicator body;

a rotary atomizing head at one end of said body; and air passages providing a natural flow of ambient air to a low pressure area behind said rotary atomizing head, each said passage having a first opening remote from said head exposed to ambient air and a second opening behind said head in the low pressure area created by rotation of said head.

2. The applicator of claim 1, including a shroud on said body behind said head, and said passages being disposed in said shroud.

3. The applicator of claim 2, said shroud having a side surface and an end surface, and each said passage having an opening thereto in each said surface.

4. The applicator of claim 3, said openings in said side surface being disposed near an opposite end of said shroud from said end surface.

5. The applicator of claim 3, said passages angling inwardly from said side surface to said end surface.

6. The applicator of claim 5, said openings in said side surface being disposed near an opposite end of said shroud from said end surface.

7. The applicator of claim 6, said shroud being frustoconical.

8. A shroud for an applicator having a rotary atomizing head, said shroud comprising:

a side wall having a side surface;

an end wall at one end of said side wall, said end wall having an end surface and defining a hole therethrough for receiving a rotary component of said atomizing head; and at least one passage defined through said side wall, each said passage having a first opening thereto in said side surface exposed to ambient air, and a second opening thereto in said end surface, said second opening being disposed near said hole.

9. The shroud of claim 8, said openings in said side surface being disposed near an opposite end of said side wall from said end wall.

10. The shroud of claim 8, said at least one passage angling inwardly from said side surface to said end surface.

11. The shroud of claim 10, said openings in said side surface being disposed near an opposite end of said side wall from said end wall.

12. The shroud of claim 11, said shroud body being frustoconical.

13. The shroud of claim 12, said end wall defining a pattern of shaping air nozzles therein, and said second openings being disposed in said end wall between said hole and said pattern of shaping air nozzles.

14. The shroud of claim 8, said end wall defining a pattern of shaping air nozzles therein, and said second openings being disposed in said end wall between said hole and said pattern of shaping air nozzles.

15. The shroud of claim 8, said shroud body being frustoconical.

16. A method of operating a rotary atomizing applicator comprising steps of:

rotating a rotary atomizing head at high speed to atomizing a coating material supplied thereto, and thereby creating an area of low pressure behind the rotating head; and directing a natural flow of ambient air through passages in said applicator having first openings exposed to ambient air and second openings behind the rotary atomizing head.

17. The method of claim 16, including providing a shroud behind the rotary atomizing head with the passages in the shroud, and directing the natural flow of air through the shroud.

18. The method of claim 17, including drawing ambient air into the passages through openings in a side surface of the shroud.

19. The method of claim of claim 18, including directing ambient air from the passages to a radially inner area behind the rotating atomizing head.

20. The method of claim of claim 16, including directing ambient air from the passages to a radially inner area behind the rotating atomizing head.

* * * * *